US006402984B1

(12) United States Patent
Nakajima et al.

(10) Patent No.: US 6,402,984 B1
(45) Date of Patent: Jun. 11, 2002

(54) COMPOSITION FOR PREVENTING CORROSION USING A SULFITE-BASED OXYGEN SCAVENGER

(75) Inventors: Junichi Nakajima, Hojo; Masazumi Yamashita; Kenichi Kimura, both of Matsuyama, all of (JP)

(73) Assignee: Miura Co., Ltd., Ehime (JP)

( * ) Notice: Subject to any disclaimer, the term of this patent is extended or adjusted under 35 U.S.C. 154(b) by 0 days.

(21) Appl. No.: 09/397,025

(22) Filed: Sep. 16, 1999

Related U.S. Application Data

(63) Continuation of application No. 09/049,120, filed on Mar. 27, 1998, now Pat. No. 6,027,687.

(30) Foreign Application Priority Data

Mar. 28, 1997 (JP) ..... 8-94783
Dec. 15, 1997 (JP) ..... 8-363539

(51) Int. Cl.[7] ..... C02F 1/70

(52) U.S. Cl. ..... 252/188.1; 252/178; 252/188.21; 252/188.22; 252/188.28

(58) Field of Search ..... 252/178, 188.1, 252/188.21, 188.22, 188.28

(56) References Cited

U.S. PATENT DOCUMENTS 2,825,651 A * 4/1958 Loo et al. ..... 426/541
3,551,349 A 12/1970 Kallfass
3,843,547 A 10/1974 Kaufman et al.
4,192,773 A * 3/1980 Yoshikawa et al. ..... 502/62
4,231,894 A 11/1980 Lavin et al.
4,278,635 A 7/1981 Kerst
4,279,767 A 7/1981 Muccitelli
4,282,111 A 8/1981 Ciuba
4,289,645 A 9/1981 Muccitelli
4,384,972 A * 5/1983 Nakamura et al. ..... 252/188.21
4,419,327 A 12/1983 Kelly et al.
4,487,708 A 12/1984 Muccitelli
4,497,713 A 2/1985 Geiger
4,663,053 A 5/1987 Geiger
4,676,910 A * 6/1987 Dubin ..... 210/696
4,702,966 A * 10/1987 Farrell et al. ..... 425/500
4,724,125 A 2/1988 Tsuneki et al.
4,874,541 A * 10/1989 Steimel et al. ..... 252/178
4,895,703 A 1/1990 Zupanovich et al.
4,948,619 A * 8/1990 Antrim et al. ..... 426/610
5,603,862 A * 2/1997 Taya et al. ..... 252/181
5,660,736 A 8/1997 Bizot et al.
5,750,037 A 5/1998 Bizot et al.
6,184,459 B1 * 2/2001 McShane et al. ..... 174/17

FOREIGN PATENT DOCUMENTS

JP 63-166980 * 7/1988

* cited by examiner

*Primary Examiner*—Arlen Soderquist
*Assistant Examiner*—LaToya Cross
(74) *Attorney, Agent, or Firm*—Birch, Stewart, Kolasch & Birch, LLP

(57) ABSTRACT

The invention effectively prevents occurrence of corrosion in water tubes or the like of boilers. The invention provides a method for operating a boiler, including regulating a concentration of sulfate ions $SO_4^{2-}$ in boiler water to under 500 ppm, and a method for injecting a sulfite base oxygen scavenger, including setting a concentration of residual dissolved oxygen in boiler feed water to 2–4 ppm. The invention further provides a sulfite base oxygen scavenger composition comprising: 3–30 weight % of at least one selected from a group consisting of $Na_2SO_3$, $K_2SO_3$, $NaHSO_3$ and $KHSO_3$; 1–20 weight % of NaOH or KOH; 0.2–2 weight % of potassium sorbate; and 5–500 ppm of $CoSO_4$.

6 Claims, No Drawings

COMPOSITION FOR PREVENTING CORROSION USING A SULFITE-BASED OXYGEN SCAVENGER

This application is a continuation of application Ser. No. 09/049,120, filed on Mar. 27, 1998 now U.S. Pat. NO. 6,027,687, the entire contents of which are hereby incorporated by reference.

BACKGROUND OF THE INVENTION

The present invention relates to suppression of corrosion that occurs in water tubes or the like of boilers. More specifically, the invention relates to a boiler operating method in which the concentration of sulfate ions $SO_4^{2-}$ in the boiler water is regulated. The invention also relates to a method for injecting a sulfite base oxygen scavenger which is added to water supplied to the boiler.

Generally, during the operation of a boiler, the pH value of the water within the water tubes, or of the boiler water, increases with generation of hydroxide ions due to thermal decomposition of bicarbonate ions contained in the feed water and with concentration of the boiler water due to evaporation. In this connection, in once-through boilers, which involve no circulation of water in the boiler body, in the degree of concentration of boiler water between upper part and lower part of the water tubes differs. As a result, the pH of boiler water increases considerably in the upper part of the water tubes, but does not increase so much in the lower part of the water tubes. This results in a water quality of nearly the same pH value as the feed water. Indeed carbon steel is widely used to make the water tubes in boilers, but carbon steel is prone to corrosion in neutral water containing oxygen. Thus, the water management for boilers involves control processes to remove dissolved oxygen in the feed water and raise the pH of the standards for boiler water. According to the water quality management in JIS (Japanese Industrial Standards), the pH of boiler water should be controlled to be around 11 to 11.8. If this level is regarded as a proper pH level, then pH in lower part of the water tubes is lower than the proper value. Accordingly, the once-through boiler is prone to corrosion in lower part of the water tubes. To prevent this corrosion, it is conventional to add agents to the feed water for the boiler. These agents are classified roughly into two kinds depending on components contained in the agents. One is called filming type agents, which are agents that form an anticorrosion film on the surface of the water-tube inner wall. The other is called oxygen scavenging type agents, which remove dissolved oxygen in the feed water, (a cause of corrosion), to prevent corrosion.

In past literature concerning water management of boilers, dissolved oxygen, low pH (operation of boilers at pH levels lower than proper ) and harmful ions (e.g., chloride ions $cl^-$, sulfate ions $SO_4^{2-}$) have been mentioned as principal causes of corrosion. However, the effect of these factors on corrosion was examined no more than only qualitatively, the case being unclear. It was also unclear whether the filming type agent or the oxygen scavenging type agent, is more effective to prevent of corrosion.

Thus, the inventors have experimented to find ways to effectively reduce corrosion of boilers. As a result, it was found that the anticorrosion effect of filming type agents is, in general, largely affected by pH, and sufficient anticorrosion effect could not be expected in a low pH region, i.e., pH=7–9. That is, the anticorrosion effect is insufficient in lower part of the water tubes in the once-through boiler. On the other hand, as a result of making similar corrosion experiments with the oxygen scavenging type agents, such as ascorbic acid, erythorbic acid, MEKO (methyl ethyl ketoxime), hydrazine and sulfite as an oxygen scavenger, it was found that anticorrosion properties do not depend so much on pH (unlike the filming type agents). The oxygen scavenging type agents exhibit a superior anticorrosion effect even with water quality in lower part of the water tubes in the once-through boiler (in a low pH region). Among these oxygen scavengers, sulfite proved to have the highest anticorrosion effect. However sulfite also proved to have a potential defect in that sulfate ions $SO_4^{2-}$ are generated after sulfite ions $SO_3^{2-}$ have reacted with dissolved oxygen in the water. Sulfate ions $SO_4^{2-}$ destroy the film anticorrosion film generated on the surface of carbon steel in the water, accelerating corrosion. As the boiler water is concentrated with evaporation, the sulfate ions $S_4^{2-}$ are also concentrated so that their increased concentration causes a considerable increase in corrosion. The present invention, having been accomplished in view of these and other problems, has an object of effectively suppressing corrosion by using a sulfite base oxygen scavenger.

SUMMARY OF THE INVENTION

The present invention has been accomplished as a result of performing many studies and experiments in view of the foregoing problems. A first aspect of the invention includes regulating a concentration of sulfate ions $S_4^{2-}$ in boiler water to 500 ppm or less. Also, a second aspect of the invention includes setting a concentration of residual dissolved oxygen in boiler feed water to 2–4 ppm. Further, a third aspect of the invention provides a sulfite-based oxygen scavenger composition comprising: 3–30 weight % of at least one selected from a group consisting of $Na_2SO_3$, $K_2SO_3$, $NaHSO_3$ and $KHSO_3$; 1–20 weight % of NaOH or KOH; 0.2–2 weight % of potassium sorbate; and 5–500 ppm of $CoSO_4$.

By keeping the concentration of sulfate ions $SO_4^{2-}$ in boiler water to 500 ppm or less, corrosion due to sulfate ions $SO_4^{2-}$ is suppressed. This corrosion suppression effect becomes even more marked when the concentration of sulfate ions $SO_4^{2-}$ is kept to 300 ppm or less.

According to published literature, even with a large amount of sulfate ions $SO_4^{2-}$, corrosion will not occur, given enough oxygen scavenging. Among corrosion data of the literature, the presence or absence of oxygen is not specifically described in terms of its concentration, where the "presence of oxygen" is unclear as to what level of ppm it is. However, the inventors have found that the quantity of corrosion is smaller when "the amount of sulfate ions $SO_4^{2-}$ is small, even with oxygen left more or less", than when "a large amount of sulfite is injected in an attempt to fully remove oxygen with the result that more sulfate ions $S_4^{2-}$ are generated". More specifically, if the concentration of dissolved oxygen in the feed water after the injection of a sulfite-based oxygen scavenger is within a range of 2–4 ppm, corrosion is suppressed. Normally, the sulfite base oxygen scavenger is added in an amount over the chemical equivalent of dissolved oxygen concentration of the water to which the oxygen scavenger is to be added. However, in the present invention, the oxygen scavenger is added in an amount under the chemical equivalent so that corrosion is prevented without increasing the amount of sulfate ions $SO_4^{2-}$ so much, with 2–4 ppm residual dissolved oxygen left.

In the present invention, examples of the sulfite base oxygen scavenger include sodium sulfite $Na_2SO_3$, potassium sulfite $K_2SO_3$, sodium hydrogensulfite $Na_2HSO_3$, potassium hydrogensulfite $KHSO_3$ and the like. At least one of the forgoing sulfite base oxygen scavengers are used, but may be used in a combination of two or more, depending on the embodiment. As to the agents used for boilers, for further enhancement of anticorrosion effect, sodium hydroxide NaOH, potassium hydroxide KOH or the like is added as a pH regulator, and polyacrylate, polymaleate or the like is added as a scale dispersing agent, as required. It is noted that potassium sorbate acts as a stabilizer for the oxygen scavenger during the storage of agents, while cobalt sulfate acts as a reaction catalyst when the agents are used.

DETAILED DESCRIPTION OF THE PREFERRED EMBODIMENTS

Hereinbelow, a concrete example of the present invention is described in detail. It is noted that the drawings of the boiler and its related equipment are omitted for the following description.

The present invention may be preferably applied to a boiler equipped with a chemical feeder for injecting agents in the feedwater line to the boiler. In a chemical fluid tank of this chemical feeder, an agent containing a sulfite base oxygen scavenger is stored, and a pH regulator for enhancing anticorrosion effect, for example, sodium hydroxide NaOH, potassium hydroxide KOH or the like. When the boiler is started, a feedwater pump provided on the feedwater line is activated to supply water to the boiler. Simultaneously, the chemical feeder is activated to inject the agent.

The sulfite base oxygen scavenger contained in the injected agent reacts with oxygen dissolved in the feed water, causing the dissolved oxygen concentration to decrease in the feed water, while sulfite ions $SO_3^{2-}$, after reaction, change into sulfate ions $SO_4^{2-}$. Meanwhile, the boiler water grows increasingly concentrated overtime, so that the sulfate ions $SO_4^{2-}$ also grow concentrated.

The present invention is now explained in more detail. According to field data from boilers into which the sulfite base oxygen scavenger was injected with analysis made by the inventors (where the boilers had been under continuous water quality management and were damaged by corrosion within a certain period), it was found that a sulfate ion $SO_4^{2-}$ concentration of 500 ppm in the boiler water forms a boundary line, where damage occurred to boilers with higher concentrations of sulfate ions $SO_4^{2-}$ and damage did not occur to boilers with lower concentrations of sulfate ions $SO_4^{2-}$. Also according to the above field data, it is estimated that at a sulfate ion $SO_4^{2-}$ concentration of about 300 ppm the corrosion rate becomes zero. Therefore, it was found and known that corrosion can be effectively suppressed by keeping the sulfate ion $SO_4^{2-}$ concentration in the boiler water under about 300 ppm.

Next, a concrete experimental example of the anticorrosion effect is explained. First, soft water (with hardness not more than 1 ppm) in which sulfite ions $SO_3^{2-}$ and sodium hydroxide NaOH were added was supplied to the boiler, followed by a certain period of operation. Then, the quantity of corrosion at a heat transfer part of the boiler was measured. Results of this are shown in Table 1.

TABLE 1

| | pH condition - I (about 11.2) | pH condition - II (about 11.9) |
|---|---|---|
| No injection of agent (NaOH only added) | 100 | — |
| <Injection condition - I> $SO_3^{2-}$ added until DO ≈ 0 ppm | 71 | 64 |
| <Injection condition - II> $SO_3^{2-}$ added until DO = 2–4 ppm | 59 | 39 |

Note 1: DO = concentration of residual dissolved oxygen
Note 2: The quantity of corrosion is given by relative values, where no injection of agents is taken as "100".

As apparent from Table 1, the case in which $SO_3^{2-}$ was added until DO=2–4 ppm (injection condition II) has a superior anticorrosion effect over the case in which it was added until DO≈0 ppm (injection condition I).

Next, a composition of the sulfite base oxygen scavenger according to the present invention is described. The description given below shows a formulation example suited to maintain the concentration of residual dissolved oxygen in the boiler feed water at 2–4 ppm. First described is the oxygen scavenger principally used for the present invention (hereinafter, referred to as "principal oxygen scavenger"). As the principal oxygen scavenger for the present invention, at least one is selected from among a group consisting of sodium sulfite $Na_2SO_3$, potassium sulfite $K_2SO_3$sodium hydrogensulfite $NaHSO_3$ and potassium hydrogensulfite $KHSO_3$. This principal oxygen scavenger and sodium hydroxide NaOH or potassium hydroxide KOH are limited to certain ratio ranges because their solubilities in the agent (aqueous solution) are fixed when formulated as a boiler chemical. Therefore, in the present invention, because the agent is diluted before use so that the concentration of residual dissolved oxygen in the boiler feed water is kept at 2–4 ppm, the principal oxygen scavenger needs to be contained to 3–30 weight %.

Next, components to be added besides the principal oxygen scavenger are explained. First, whereas the concentration of sodium hydroxide NaOH or potassium hydroxide KOH is determined depending on the M-alkalinity in the feed water supplied to the boiler, it is desirably provided in the agent at 1–20 weight % in terms of concentration relative to the principal oxygen scavenger. Also, potassium sorbate is used as a preservation stabilizer for the principal oxygen scavenger, and correspondent to the formulation ratio of the principal oxygen scavenger, being desirably contained to 0.2–2 weight %. In addition, cobalt sulfate $CoSO_4$ acts as a catalyst in reaction between the principal oxygen scavenger and dissolved oxygen, and, its concentration being correspondent to the formulation ratio of the principal oxygen scavenger, is desirably contained to 5–500 ppm.

As shown above, according to the present invention, by managing the sulfate ion $SO_4^{2-}$ concentration in the boiler water to under 500 ppm, corrosion in the boiler can be effectively suppressed. Also, since the concentration of residual dissolved oxygen in the boiler feed water is set to 2–4 ppm by injecting the sulfite base oxygen scavenger, the progress of corrosion can be suppressed.

What is claimed is:

1. A boiler feed water containing a sulfite-based oxygen scavenger, comprising:

the boiler feed water; and the sulfite based oxygen scavenger in an amount effective to set a level of dissolved oxygen to 2–4 ppm, wherein, the sulfite based oxygen scavenger comprises 0.2–2 wt % of potassium sorbate, 5–500 ppm of $CoSO_4$ and 3–30 wt % of at least one $K_2SO_3$ or $KHSO_3$.

2. The boiler feed water according to claim 1, further comprising 1–20 wt % of NaOH or KOH.

3. A boiler feed water containing a sulfite-based oxygen scavenger, comprising:

the boiler feed water; and the sulfite based oxygen scavenger in an amount effective to set a level of dissolved oxygen to 2–4 ppm, wherein, the sulfite based oxygen scavenger comprises 0.2–2 wt % of potassium sorbate and 3–30 wt % of at least one compound selected from the group consisting of $Na_2SO_3$, $K_2SO_3$, $NaHSO_3$ and $KHSO_3$.

4. The boiler feed water according to claim 2, further comprising 1–20 wt % of NaOH or KOH.

5. The boiler feed water according to claim 3, further comprising 5–500 ppm $CoSO_4$.

6. The boiler feed water according to claim 4, further comprising 5–500 ppm $CoSO_4$.

* * * * *